United States Patent [19]

De Filippis et al.

[11] Patent Number: 4,696,579

[45] Date of Patent: Sep. 29, 1987

[54] THERMOSTAT

[75] Inventors: Pietro De Filippis; Ciro Calenda, both of Aversa; Giuseppe Notaro, Pomigliano D'Arco, all of Italy; Henry Boulanger, Nicholasville, Ky.

[73] Assignee: Texas Instruments Incorporated, Dallas, Tex.

[21] Appl. No.: 781,619

[22] Filed: Sep. 30, 1985

[30] Foreign Application Priority Data

Oct. 24, 1984 [IT] Italy ..... 49059 A/84

[51] Int. Cl.[4] ..... H01H 37/12; H01H 37/54

[52] U.S. Cl. ..... 374/187; 337/368

[58] Field of Search ..... 337/365, 367, 368; 156/73.1; 374/187

[56] References Cited

U.S. PATENT DOCUMENTS

| | | | |
|---|---|---|---|
| 2,824,194 | 2/1958 | Moorhead | 200/138 |
| 3,352,986 | 11/1967 | Doherty | 337/368 |
| 3,705,380 | 12/1972 | Roberts | 156/73.1 |
| 3,870,229 | 3/1975 | Manecke | 337/368 |
| 3,921,198 | 11/1975 | Pohl | 337/337 |
| 4,048,611 | 9/1977 | Kuczynski | 337/365 |
| 4,059,817 | 11/1977 | Hollweck | 337/367 |
| 4,117,443 | 9/1978 | Hofsass | 337/367 |
| 4,328,406 | 5/1982 | Evans et al. | 200/293 |
| 4,551,702 | 11/1985 | Hire | 337/368 |

*Primary Examiner*—Richard R. Stearns

*Attorney, Agent, or Firm*—James P. McAndrews; John A. Haug; Melvin Sharp

[57] ABSTRACT

A thermostat equipped with a bimetallic element sensitive to a given temperature comprises a monolithic base open at one end in which two terminals connectable to an electric circuit are inserted and precisely located, each having one end bent at a right angle and each carrying a stationary contact, an element carrying movable contacts for connecting the stationary contacts with one another, a spring housed in a seat on said base biasing the movable contact element to engage the stationary contacts, a sliding element for moving and guiding said movable contact-carrying element, a bimetallic element suitably spaced from the said sliding element for initiating movement of the sliding element in response to temperature change, and a lid which fastens the said bimetallic element to the said base with said spacing from the sliding element.

6 Claims, 16 Drawing Figures

THERMOSTAT

BACKGROUND OF THE INVENTION

The present invention relates to a single-temperature thermostat, provided with a bimetallic element sensitive to a given intervening and restoring temperature.

Various types of thermostats with bimetallic elements are already known from the prior art. These thermostats are, however, of complex structure and thus expensive, and tend to have space requirements that often pose mounting problems.

Thus, for example, from German Patent Publication No. 2 45 1327 a thermostat is known wherein a bimetallic disc operates a shaft that acts on an elastic strip secured at one end so as to raise the second end and interrupt the electric circuit. This structure is complex and cumbersome, and requires a special configuration for the terminal carrying the stationary contact and for the elastic strip carrying a movable contact.

BRIEF SUMMARY OF THE INVENTION

Object of the present invention is therefore to provide a one-temperature thermostat with a bimetallic element having a simple structure and able to assure optimal reliability.

According to the invention, the above object is achieved by providing a monolithic cylindrical base, open at one end, wherein two terminals connectable to an electric circuit are inserted, having one of their ends bent 90° and carrying a stationary contact, an element carrying a movable contact that connects the said two stationary contacts by the action of a spring, and a sliding element able to raise the said movable contact by the effect of a bimetallic element fastened in the said open end of the base by means of a lid.

This structure of a thermostat is arranged in a novel way so that, aside from being very simple, it also offers the advantage that the entire thermostat can be easily and rapidly assembled, reducing besides the cost of production.

It should be noted that the terminals have the double function, namely of external connection and fixed contact holder. In addition, the shape of the base and of the terminals themselves allows bending the terminals at any angle desired so as to satisfy the various interconnect requirements of the trade.

The said lid is made in form of a bowl that is suitably shaped in a novel way around on the outside so as to allow it application on the base of the thermostat by means of a simple cylindrical die which fitted onto the said lid folds in the outward bent rim on a lower projection of the base of the thermostat, thus avoiding a rolling, folding or the like and speeding up the fastening operation of the lid.

In addition, the said lid is shaped so as to pass all vertical stresses onto the said rim of the base, thus preventing any interferences on the disc on the part of the lid in consequence of blows or deformations accidentally suffered by the latter.

DESCRIPTION OF THE DRAWINGS

Other advantages and features of the present invention will become evident from the description of the two embodiments thereof, as illustrated by way of example in the attached drawings, wherein.

DESCRIPTION OF THE PREFERRED EMBODIMENTS

Figure 1:
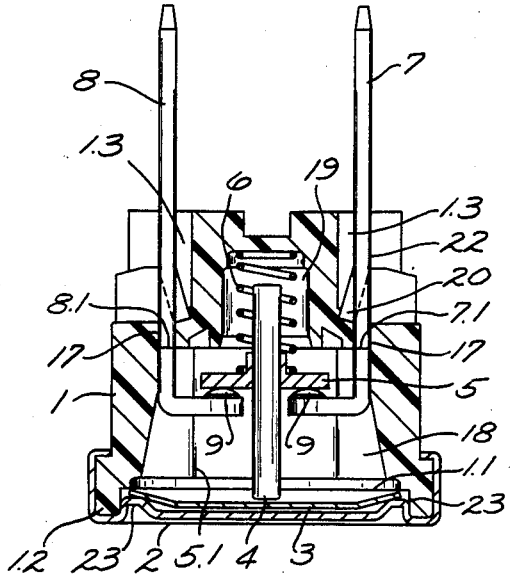
FIG. 1 shows a longitudinal view in cross section of a first embodiment of the thermostat.

FIG. 1 shows a first embodiment of a thermostat according to the invention. The said thermostat consists of a cylindrical base or body 1 of plastic material having a lower cavity 18. In diagrammatically opposite positions, two slits 17 are provided which pass from the lower cavity to the outside through the upper closed wall of body 1. In the upper part of the said body a cylindrical seat 19 is provided in which a helical spring 6 is mounted whose upper end is supported on the bottom of said seat 19. Into the said slits 17 of rectangular configuration terminals 7 and 8 are inserted whose lower ends are bent at right angles and each carrying a contact 9. In spring 6 a rod 4 of ceramic material is inserted on which, with a force fit, a contact plate 5 of steel or other magnetic material is slipped which supports itself on the said two contacts 9 of terminals 7 and 8 so the plate 5 and rod 4 are fixed together and movement of the rod is guided in the seat 19.

The union between rod 4 and contact plate 5 is calibrated so that the lower end of the said rod 4 is slightly above a conventional thermally responsive, snap-acting bimetallic disc 3 whose rim is captured between a shoulder 1.1 at the mouth of cavity 18 and the upward bent rim of a lid 2. Preferably ends of the plate 5 are guided in a groove 5.1 in the body.

Figure 6:
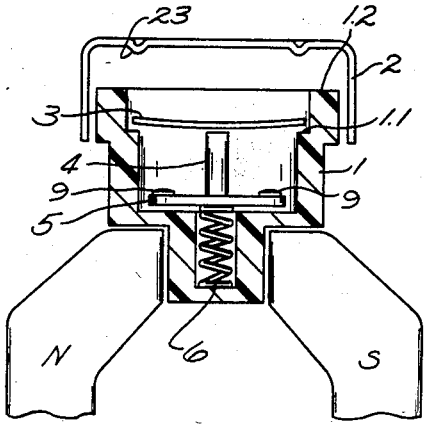
FIG. 6 is a diagrammatic view which shows a method for assembling the bimetallic disc and the lid into the thermostat.
Figure 7A:
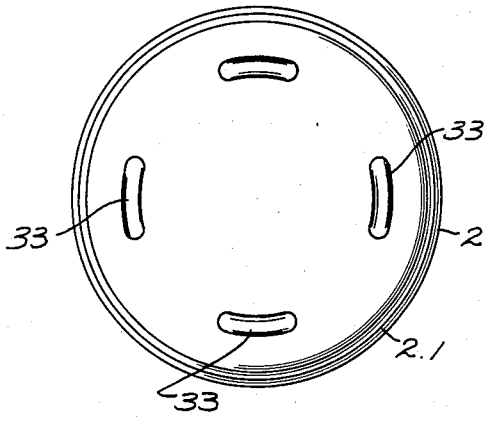
FIG. 7*a* shows a front view of one embodiment of the lid.
Figure 7B:
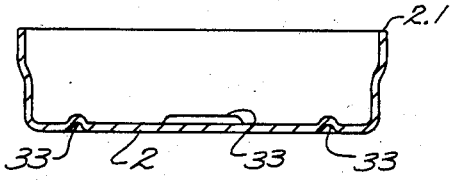
FIG. 7*b* shows a crosssectional view along line A—A of FIG. 7*a;*
Figure 8A:
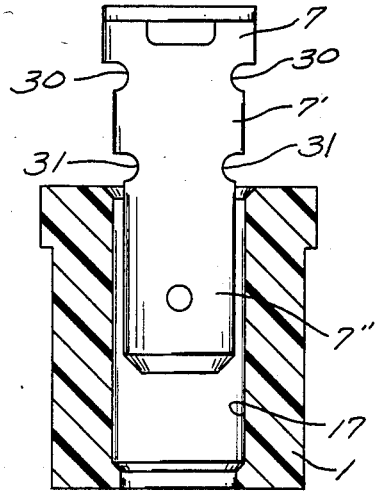
FIGS. 8*a* and 8*b* diagrammatically show another alternate method for mounting the terminals by ultrasound.
Figure 8B:
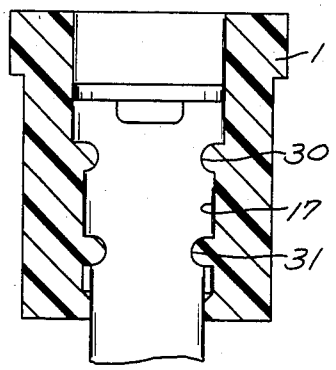
Figure 9A:
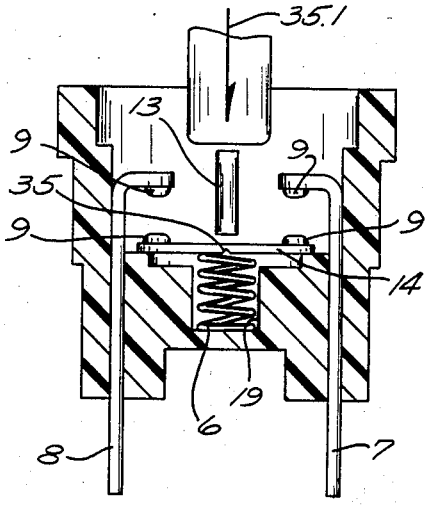
FIGS. 9*a*, 9*b* and 9*c* show a method for calibrating the thermostat with a movable notched plate.
Figure 9B:
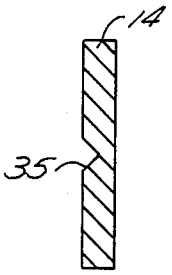
Figure 9C:
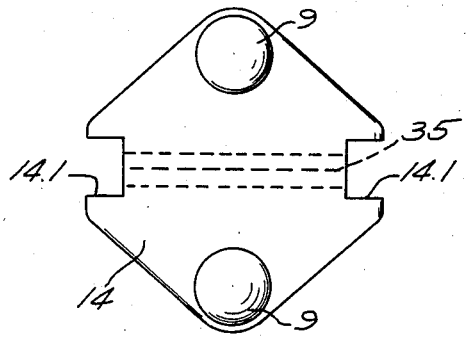

To assemble bimetallic disc 3 and lid 2, a magnetic field is applied to the contact plate 5 by poles N and S so as to attract it toward the base, with compressing of spring 6, as shown schematically in FIG. 6. In this way, also rod 4 is caused to retreat, thus creating a free space for easy insertion of disc 3 and mounting of the lid 2. Subsequently, the magnetic field is removed and the said contact plate 5, by the action of spring 6, returns to its normal position.

Thanks to this calibration of shaft 4, at the moment of reversal of bimetallic disc 3 in consequence of a temperature increase, the latter abruptly strikes shaft 4 thus causing an interruption of the electric current by the lifting of said contact plate 5 from contacts 9 of terminals 7 and 8, against the action of spring 6. In this way, the period of arcing between the contacts is reduced to a minimum.

The same applies to the closing phase of the contacts, that is, the return of the bimetallic disc to its starting position on cooling of the disc.

Thus to assure this abrupt opening and closing of the contact it is necessary to provide, during the assembly phase of the various components of the thermostat, and initial creep-action play between the bimetallic disc and the rod of ceramic material. It should moreover be made sure that this play is kept as small as possible on account of a much larger abrupt or snap acting movement portion than a gradual portion existing in the travel of the said bimetallic disc.

The said lid 2 is shaped cylindrically around on the outside with a flared rim 2.1 so as to allow its application on the base by way of a simple forced insertion of lid 2 resting on the edge 1.2 of base 1 in a simple die of circular configuration. This manner of fastening the said lid is much faster and much more effective than rolling or folding as presently used.

The said lid 2 is shaped so as to unload vertical stresses, caused by possible deformations of the lid when in operation, onto the rim 1.2 of base 1, thus absolutely preventing any deformations or stresses of the lid from being transmitted to the bimetallic disc and thus altering its characteristics.

In fact, the lid 2 has a circular projection 23 which closely follows the internal flange or shoulder 1.1 of base 1, the said bimetallic disc 3 being wedged between said circular projection 23 and said internal flange of base 1.

FIGS. *7a* and *7b* show another design of lid wherein the circular projection 23 is replaced by four projecting sectors 33 uniformly distributed over a circular circumference, which equally function as support of the disc and assist in calibration of the thermostat.

Figure 2:
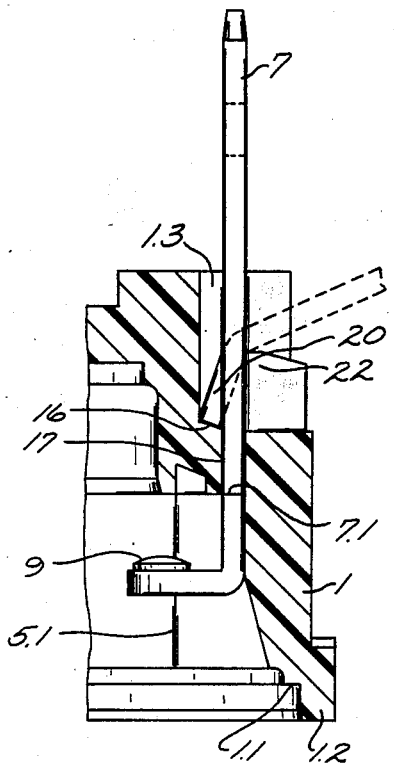
FIG. 2 shows an enlarged partial cross section view as shown in FIG. 1 illustrating a terminal fastened in the base of the thermostat.
Figure 3:
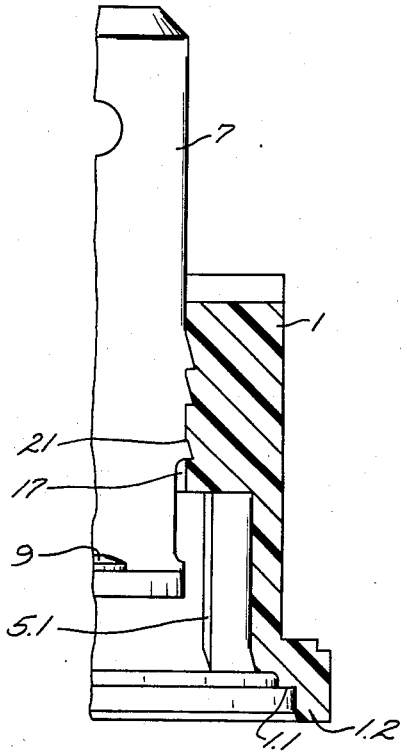
FIG. 3 shows a front view of a terminal similar to that shown in FIG. 2 illustrating an alternate embodiment of the invention.

The terminals 7 and 8, made in one piece, preferably have a tongue 20 as shown in FIGS. 1 and 2 which during mounting enmeshes itself in the terminal inside the base until a terminal shoulder 7.1, 8.1 engages the base but which is then dislodged into narrow slot 1.3 in the base for wedging it against a corresponding shoulder 16 on the outside of the said base. The terminals 7, 8 can be bent against above tongue 20 around a shoulder 22 along side the narrow slot 1.3 without their strong fixation inside the base being impaired thanks to the combined action of tongue 20 and shoulder 16 and 22 which act in unison toward improving the said fixation. In an alternate embodiment the terminals have small teeth 21 which engage, during mounting, in corresponding cutouts of said base 1, as shown in FIG. 3.

The insertion of the terminals in the base can be effected by ultrasonic energy. As illustrated schematically in another alternate embodiment in FIGS. *8a* and *8b*, a terminal 7 has three sectors 7, 7' and 7'' of decreasing widths which are joined laterally by marginal grooves 30 and 31 of equal radiuses.

Under the action of ultrasonic vibrations, the said terminal 7 penetrates in base 1 while heating up, the so developed heat superficially melting a thin layer of the material of the base which after completion of the insertion (FIG. *8b*) will have filled up again the said cavities 30 and 31, thus assuring a perfect fixation and sealing of terminal 7 in base 1.

Figure 4:
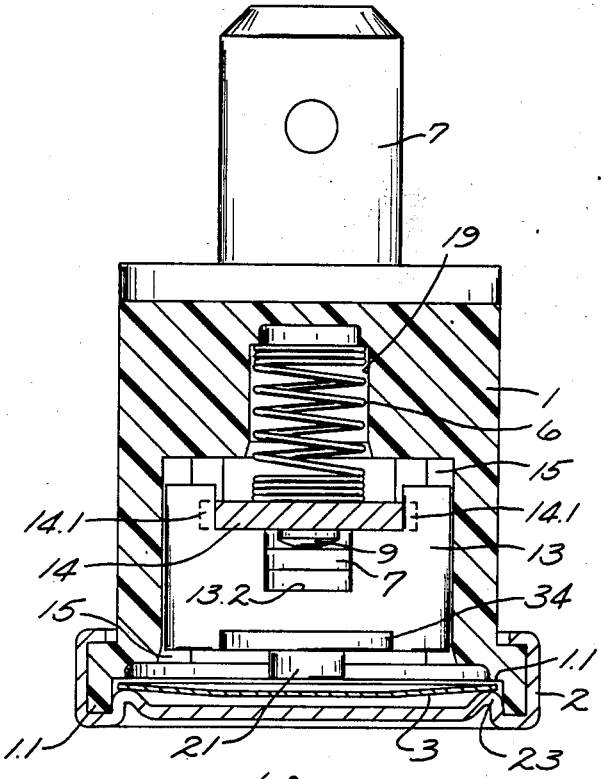
FIG. 4 shows another alternate embodiment of the thermostat.
Figure 5:
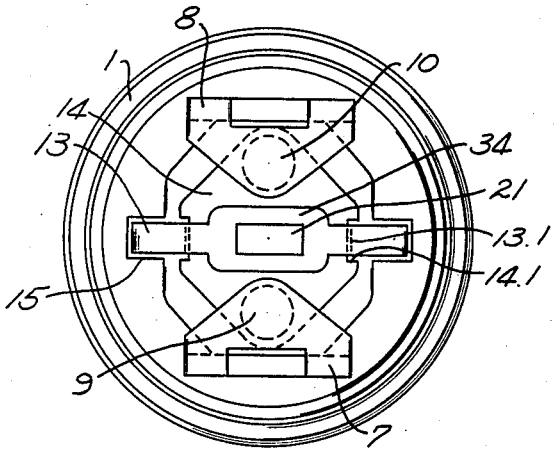
FIG. 5 shows a top view of the thermostat of FIG. 4 with the lid removed.

FIGS. 4 and 5 show a second embodiment of the invention, which differs from that shown in FIG. 1 in that the rod 4 of ceramic material is replaced by a motion transfer guide plate 13 preferably of insulating material such as plastic, ceramic or similar material, which is guided into diametrically opposed grooves 15, made in the cavity 18. On the outer end of spring 6 a contact plate 14 carrying movable contacts is fastened, in the manner similar to plate 5 of the first embodiment. A guide plate 13 preferably has raised edges 13.1 and a central depression 13.2 and the contact plate has grooves 14.1 fitted around parts of the raised edges 13.1 of the guide plate in this case, the guide plate 13 and contact-holding plate 14 also moved together but the movement is guided by the grooves 15 and not by the seat 19 as in the version of FIG. 1.

The said plate 13 has a lug 21 whose distance from bimetallic disc 3 is suitably chosen, in accordance with the type of bimetal used to provide a desired calibration of the thermostat.

Another kind of calibration is shown schematically in FIGS. *9a* and *9b*. Here, the movable contact plate 14 has a V-shaped notch 35 at its center which facilitates bending of the said plate by a force 35.1 as indicated in FIG. *9a* to an extent desired and thus permit the calibration of the distance of the guide plate 13 from the said bimetallic disc. The said notch prevents, moreover, an application of larger bending forces that could damage the rim of the base on which the movable contact plate 14 supports itself.

Figure 10B:
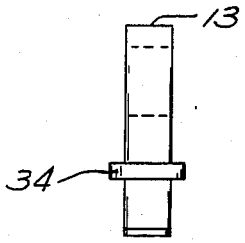
FIG. 10*b* shows a crosssectional view along line B—B of FIG. 10*a*.
Figure 10A:
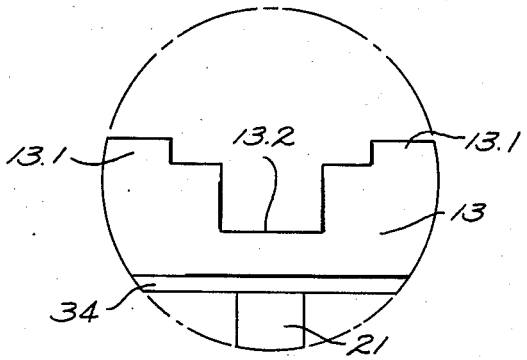
FIG. 10*a* shows a front view of the sliding guide plate for the movable contact as used in the thermostat of FIGS. 4 and 5.

The guided plate 13 preferably has two lateral projections 34, as shown in FIG. 10, which serve to pose a substantially longer resistance path to the passage of creep surface currents that could otherwise travel from the plate 14 along the insulator 13 and unload onto the bimetallic element and thus on the lid.

The said lid 2 has a circular projection 23 that closely follows the inner flange of base 1, the said bimetallic element being fastened to said inner flange of the base by said circular projection 23 of the lid when the latter is fastened on base 1.

This embodiment of FIGS. 4 and 5 is particularly suited for more elevated temperatures, above 200° C. for example, to which the contact plate 5 of FIG. 1 could rise causing local fusions in the groove 5.1 of plastic in which it is guided. In this case, instead, thanks to the guided sliding of plate 13 in the grooves 15 of the base, the said drawback is avoided. In fact, the plate 13, being thermally insulated from the contact plate 14, never reaches temperatures that are dangerous for the plastic of the base in which it is guided.

Figure 11:
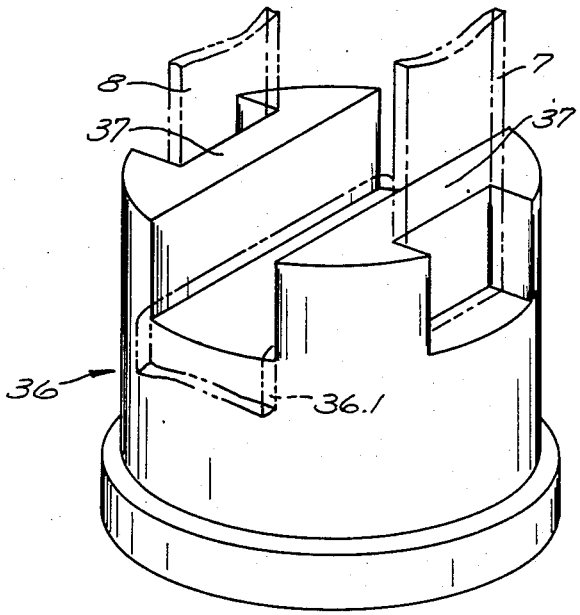
FIG. 11 shows a view in perspective of the monolithic base of the thermostat diagrammatically illustrating mounting of the thermostat.

It should finally be noted that the monolithic base, as shown schematically in perspective view in FIG. 11, has a useful surface 36 for the application of a clip 36.1 for mounting the thermostat on the based to be thermostated, this being made possible by virtue of the fact that terminals 7, 8 are separated from the ring by two barriers 37 formed in the monolithic base itself.

The present invention has been described on hand of several preferred embodiments thereof; it should be understood, however, that various modifications and variations can be made without for that matter departing from the scope of protection of the present invention:

We claim:

1. A thermostat comprising a monolithic base having a chamber open at one end, two terminals connectable to an electric circuit inserted into the base, each terminal carrying a stationary contact within the base chamber, a movable contact element movable between a position interconnecting the stationary contacts and a position spaced from said stationary contacts, a spring mounted in the base biasing the movable contact element to one of said positions relative to the stationary contacts, a thermally responsive bimetallic element movable in response to temperature change, a sliding element for moving the movable contact element against biasing of the spring in response to movement of the bimetallic element, and a lid which positions said bimetallic element on said base characterized in that the sliding element is adjustably joined in operative relation to the movable contact element for disposing an extending portion of the sliding element with a selected spacing from the movable contact element in a selected position between the movable contact element and the bimetallic element for calibrating the thermostat to move the movable contact element from one of said positions to the other position against biasing of said spring when the bimetallic element moves in response to selected temperature change.

2. Thermostat as set forth in claim 1 further characterized in that said sliding element comprises a rod and the movable contact element has an opening, the rod and movable contact element being adjustably joined by means of a force fit of the rod in said opening in the movable contact element, to be calibrated with great accuracy free of hard-to-control effects such as elastic return so that an extending portion of rod at one end of the rod is disposed in precisely said selected position relative to the movable contact element and said bimetallic element.

3. Thermostat comprising a monolithic base having a chamber open at one end, two terminals connectable to an electric circuit inserted into the base, each terminal carrying a stationary contact within the base chamber, a movable contact element movable between a position interconnecting the stationary contacts and a position spaced from said stationary contacts, a spring mounted in the base biasing the movable contact element to one of said positions relative to the stationary contacts, a thermally responsive bimetallic element movable in response to temperature change, a sliding element for moving the movable contact element against biasing of the spring in response to movement of the bimetallic element, and a lid which positions said bimetallic element on said base, the sliding element being adjustably joined in operative relation to the movable contact element for disposing an extending portion of the sliding element with a selected spacing from the movable contact element in a selected position between the movable contact element and the bimetallic element for calibrating the thermostat to move the movable contact element from one of said positions to the other position against biasing of said spring when the bimetallic element moves in response to selected temperature change, said base having a shoulder formed therein in the base chamber at the open end of the chamber, the lid abutting the base at its open end and having a circular projection means extending into the base chamber, and said bimetallic element having a rim portion thereof captured between said base shoulder and said circular projection means of the lid for shielding the bimetal from deformations and stresses to which the lid may be subjected.

4. Thermostat as set forth in claims 3 further characterized in that said lid has a plurality of projections spaced on a common circumference cooperating to form said circular projection means so that after determination of the actual point in which lug of said guide plate finds itself with the movable contact element in a selected position further calibration of the thermostat is adapted to be made by squeezing the said projections to obtain a more precise spacing between the bimetallic element and the extending portion of the sliding element.

5. Thermostat comprising a monolithic base having a chamber open at one end, two terminals connectable to an electric circuit inserted into the base, each terminal carrying a stationary contact within the base chamber, a movable contact element movable between a position interconnecting the stationary contacts and a position spaced from said stationary contacts, a spring mounted in the base biasing the movable contact element to one of said positions relative to the stationary contacts, a thermally responsive bimetallic element movable in response to temperature change, a sliding element for moving the movable contact element against biasing of the spring in response to movement of the bimetallic element, and a lid which positions said bimetallic element on said base, the sliding element being adjustably joined in operative relation to the movable contact element for disposing an extending portion of the sliding element with a selected spacing from the movable contact element in a selected position between the movable contact element and the bimetallic element for calibrating the thermostat to move the movable contact element from one of said positions to the other position against biasing of said spring when the bimetallic element moves in response to selected temperature change, and said monolithic base having an exterior groove for receiving a metal clip for mounting the thermostat on a surface whose temperature is to be monitored by the thermostat for disposing portions of the base material on either side of said groove as barriers between the terminals and said clip for providing electrical insulation therebetween.

6. A thermostat comprising a monolithic base having a chamber open at one end, two terminals connectable to an electric circuit inserted into the base, each terminal carrying a stationary contact within the base chamber, a movable contact element movable between a position interconnecting the stationary contacts and a position spaced from said stationary contacts, a spring mounted in the base biasing the movable contact element to one of said positions relative to the stationary contacts, a thermally responsive bimetallic element movable in response to temperature change, a sliding element for moving the movable contact element against biasing of the spring in response to movement of the bimetallic element, and a lid which positions said bimetallic element on said base, the sliding element being adjustably joined in operative relation to the movable contact element for disposing an extending portion of the sliding element with a selected spacing from the movable contact element in a selected position between the movable contact element and the bimetallic element for calibrating the thermostat to move the movable contact element from one of said positions to the other position against biasing of said spring when the bimetallic element moves in response to selected temperature change, the sliding element comprising a rod, the movable contact element having an opening, and the rod and movable contact element being adjustable joined by means of a force fit of the rod in said opening in the movable contact element to be calibrated with great accuracy free of hard-to-control effects such as elastic return so that an extending portion of the rod at one end of the rod is disposed in precisely said selected position relative to the movable contact element and said bimetallic element, and the base having a recess receiving the spring therein, and an opposite end of the rod being slidably received in the recess to be guided therein during movement of the movable contact element between said positions.

* * * * *